United States Patent [19]

Urien et al.

[11] Patent Number: 4,578,658

[45] Date of Patent: Mar. 25, 1986

[54] PROCESS FOR THE PRODUCTION OF AN ULTRA-HIGH FREQUENCY CAVITY RESONATOR AND CAVITY RESONATOR OBTAINED BY THIS PROCESS

[75] Inventors: Jacques Urien, Maurepas; Elie Bressan, L'Union; Jacques Danguy, Sartrouville; Marcel Narzul, Bazemont, all of France

[73] Assignee: Thomson-CSF, Paris, France

[21] Appl. No.: 582,230

[22] Filed: Feb. 21, 1984

[30] Foreign Application Priority Data

Feb. 25, 1983 [FR] France ..... 83 03126

[51] Int. Cl.[4] ..... H01P 7/06; H01P 11/00

[52] U.S. Cl. ..... 333/227; 29/600; 333/248

[58] Field of Search ..... 333/202-212, 333/219-236, 239-245, 248-252, 99 R, 99 S; 29/600; 219/61

[56] References Cited

U.S. PATENT DOCUMENTS

| | | | |
|---|---|---|---|
| 2,981,908 | 4/1961 | Thompson, Jr. et al. | 333/229 |
| 3,157,847 | 11/1964 | Williams | 29/600 X |
| 3,372,471 | 3/1968 | Kuhn | 29/600 |
| 3,529,267 | 9/1970 | Gunderson et al. | 333/230 X |

OTHER PUBLICATIONS

Thompson, Jr. et al.—"Fabrication Techniques for Ceramic X-Band Cavity Resonators", The Review of Scientific Instruments, vol. 29, No. 10, Oct. 1958; pp. 865-868.

*Primary Examiner*—Marvin L. Nussbaum

*Attorney, Agent, or Firm*—Cushman Darby & Cushman

[57] ABSTRACT

The process consists of preshaping the elements of the cavity prior to their assembly, covering the preshaped elements with at least one good electricity-conducting metal coating, positioning the different elements to form the cavity and then fixing all the elements to one another by melting and then cooling the deposited metal covering said cavity elements.

3 Claims, 2 Drawing Figures

FIG. 1
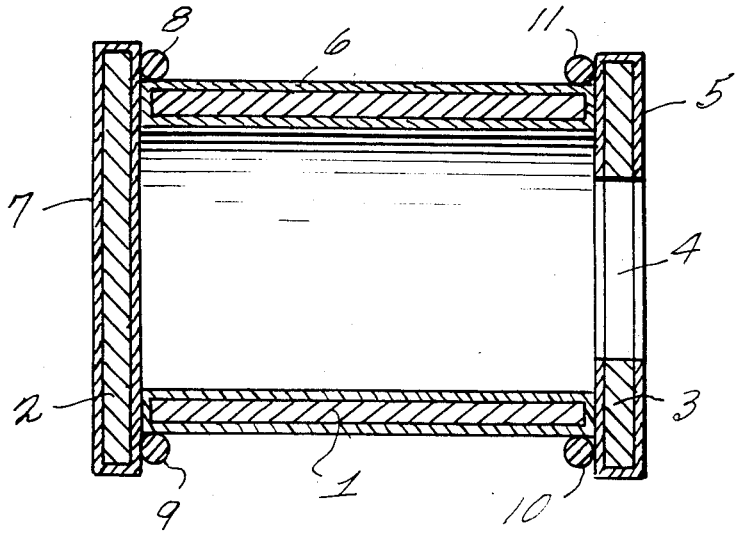
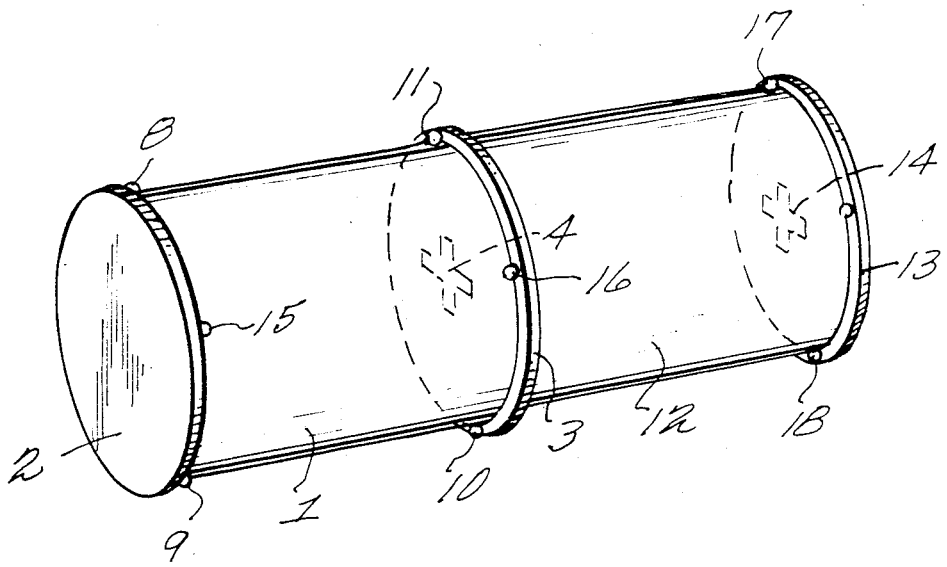
FIG. 2

PROCESS FOR THE PRODUCTION OF AN ULTRA-HIGH FREQUENCY CAVITY RESONATOR AND CAVITY RESONATOR OBTAINED BY THIS PROCESS

BACKGROUND OF THE INVENTION

The present invention relates to a process for the production of an ultra-high frequency cavity resonator and to a cavity resonator obtained by this process. It more particularly applies to a construction of ultra-high frequency filters and cavity resonators for telecommunications satellites.

An ultra-high frequency cavity resonator, hereinafter called cavity, is constituted by a dielectric medium, generally air or a vacuum, surrounded by a metal envelope forming an enclosure and whose dimensions are such that an electromagnetic wave is caused to resonate within the enclosure.

In spatial construction procedures and when a high thermal stability is required, the cavities are obtained either by the mechanical assembly of parts machined from an iron-nickel alloy, or by the mechanical assembly of parts made from a metallized resin—synthetic fiber composite material. These two solutions make it possible to obtain both a low expansion coefficient and good mechanical strength.

The iron—nickel alloy cavities are heavy, which is highly disadvantageous when they are used in satellites. In order to reduce their weight, attempts have been made to reduce the thickness of the envelope, but below a certain thickness it is no longer possible to machine the cavity without causing deformation.

In the second case, the cavities made from synthetic materials, e.g. carbon fibers, have lightweight structures and particularly appropriate mechanical characteristics for the constraints imposed by the construction of satellites, but their construction costs are high.

Finally, as in both cases the filters are produced by the mechanical assembly of elementary cavities, the intersection planes to a certain extent limit the electrical performance levels.

SUMMARY OF THE INVENTION

The object of the present invention is to obviate the aforementioned disadvantages. The present invention consequently relates to a process for the production of an ultra-high frequency cavity resonator in which the various elements thereof are preshaped prior to assembly, the process consisting of covering the preshaped elements with at least one good electricity-conducting metal coating, positioning the different elements to form the cavity, followed by fixing the assembly of the elements by melting and then cooling the deposited metal covering said cavity elements.

The main advantage of this process is that it permits, as a result of the melting of the deposited metal, both the mechanical interconnection of the elementary parts and ensures a perfect electrical continuity between the inner walls of the thus obtained cavities because, the metal deposits covering each elementary part, combine to form a homogeneous crystalline structure.

Moreover, by carefully choosing the nature and thicknesses of the deposits covering each elementary part, it is possible to obtain compositions able to melt at constant temperatures below the melting point of each of the constituents. This feature is of particular interest, especially in the case where the preshaped elements are made from an iron—nickel alloy with a very low expansion coefficient and in the case where the deposits are based on silver and copper.

BRIEF DESCRIPTION OF THE DRAWINGS

The invention is described in greater detail hereinafter relative to non-limitative embodiments and the attached drawings, wherein FIG. 1 is a preassembly procedure for the elements forming the cavity and serving to hold the elements during the melting operation; and FIG. 2 is an ultra-high frequency filter obtained with the aid of the process according to the invention.

DETAILED DESCRIPTION OF THE INVENTION

The cavity shown in FIG. 1 comprises an internally hollowed out section 1 having a cylindrical, parallelpiped or similar shape, to the ends of which are joined two metal plates 2, 3, one forming the bottom of the cavity and the other the cover. In the case of FIG. 1, the cover 3 is centrally perforated by a slot 4 forming an iris and which can optionally permit the coupling of the cavity to another adjacent cavity.

The process according to the invention consists of separately manufacturing each of the parts 1, 2 and 3 by stamping, rolling—welding, cutting or any other equivalent preshaping procedure of a metal sheet having a limited thickness of approximately 0,4 mm and of a material with a low expansion coefficient, constituted e.g. by an iron—nickel alloy, of the type marketed under the tradename "Invar", or any other equivalent material.

In a second stage of the process, each of the parts 1, 2 and 3 is covered by successive deposits 5, 6 and 7 of good electricity-conducting materials and constituted e.g. in the case when the parts are made from iron—nickel of a first copper coating and a second silver coating, the assembly having a thickness roughly equal to 5 microns or greater, as a function of the frequency of the electromagnetic wave having to resonate within the cavity. In this case, the copper coating serves as an adhesion coating for fixing the silver coating. The electrodeposition processes using an electrolytic procedure or any equivalent means making it possible to perform these operations are known and consequently there is no need for a detailed description thereof.

In a third stage, parts 1, 2 and 3 forming the elements of the cavity are positioned relative to one another in accordance with the assembly mode shown in FIG. 1 in order to form the cavity. Steel balls 8 to 11 are each welded between two adjacent elements in order to ensure a rigid mechanical connection of all the elements to one another prior to the following brazing operation. In FIG. 1 the faces of bottom 2 and cover 3, in contact with the ends of section 1, have surfaces differing from those of the end sections, respectively in contact with section 1, in order to enable each ball to abut in the angle formed by the adjacent parts which it connects. According to a preferred embodiment of the invention, the balls are welded between each adjacent part by a spot welding process consisting of producing an electrical discharge between each of the balls and the parts or adjacent elements to be connected. In order to perform this discharge, the ball is e.g. firstly maintained at the end of an electric current supply electrode by means of a known and not shown vacuum gripping means and is then brought into contact with the adjacent parts to be joined.

The electric power used is determined for each type of cavity, more particularly as a function of the thickness of the metal deposit covering each part or element and must be adequate to enable the ball to traverse the deposit and for it to be welded to the underlying metal portions without damaging them.

The fourth stage of the process consists of bringing about the final assembly by brazing together the parts preassembled in the third stage in a furnace heated to a high temperature or in any equivalent means, for bringing about the melting of the metal deposit covering the metal parts 1, 2 and 3 in one or more operations. At the end of the fourth stage, the thus assembled cavity is slowly cooled to obtain a simultaneous connection of all the parts which have been heated. For information, the process according to the invention makes it possible to bring about a simultaneous brazing of the preassembled iron—nickel parts having a thickness of approximately 0.4 mm of a cavity, which is covered with a copper—silver deposit thickness of 5$\mu$ by melting the deposit at a temperature of up to 850° C.

At this stage of the process, it is possible that the surface conductivity of the inner walls of the cavity has to be improved. In this case, the process described hereinbefore is advantageously completed by a complementary electrolytic silver deposit.

The process described hereinbefore is naturally not limited to the manufacture of a cavity of the type shown in FIG. 1 and numerous constructional variants are possible thereto and more particularly, as a result of the process according to the invention, it is possible to obtain by brazing in one or more operations the assembly of several cavities placed end to end, in order to form e.g. an ultra-high frequency filter of the type shown in FIG. 2.

The filter of FIG. 2 is formed by two cavities placed end to end. A first cavity comprises the same elements as that of FIG. 1 and is designated by the same references 1 to 4 and the second cavity is constituted by a section 12, whereof one end is placed in contact with the cover 3 of the first cavity and whose other end is closed by a cover 13, centrally perforated by an iris 14. As in the case of the cavity of FIG. 1, the filter elements are separately manufactured and then assembled by welding balls such as balls 8 to 11 and 15 to 18 shown in FIG. 2. Moreover, although the preassembly procedure described hereinbefore eliminates the use of complicated tools, which could be used for the preassembly of the elementary parts prior to the brazing operation, it is to be understood that this preassembly mode does not exclude the use of other tools. More particularly in the case of constructional variants, it is possible to replace the balls by other objects having random shapes, which can be used for holding the elementary parts during the brazing operation and in certain cases it is even possible to carry out direct spot welding of the assembled adjacent elements without the use of intermediate steel objects.

What is claimed is:

1. A method of manufacturing an ultra-high frequency cavity resonator comprising a plurality of parts including a hollowed out section, a bottom plate and a cover plate, said method comprising the steps of:

separately manufacturing said plurality of parts out of metal having a low expansion coefficient;

depositing on each of said plurality of parts at least one layer of a metal having good electricity conducting characteristics;

positioning said plurality of parts so as to define a cavity resonator assembly, and maintaining said assembly by positioning means;

submitting this assembly to a temperature elevation sufficiently high to produce melting of said layers of metal; and slowly cooling said assembly.

2. The method according to claim 1 in which said positioning step includes the step of placing metal balls in contact with adjacent parts of said plurality of parts and the step of welding said metal balls to said adjacent parts.

3. The method according to claim 2 in which said welding step is performed by applying an electrical discharge between said metal balls and said adjacent parts.

* * * * *